US005484179A

United States Patent [19]

Mader

[11] Patent Number: 5,484,179

[45] Date of Patent: Jan. 16, 1996

[54] FAILSAFE ELECTRIC LOCKING LEVER TRIM

[75] Inventor: Gerald E. Mader, Indianapolis, Ind.

[73] Assignee: Von Duprin, Inc., Indianapolis, Ind.

[21] Appl. No.: 173,283

[22] Filed: Dec. 27, 1993

[51] Int. Cl.[6] ..... E05B 3/00

[52] U.S. Cl. ..... 292/336.3; 292/34; 292/DIG. 26; 292/169.14; 70/283

[58] Field of Search ..... 292/DIG. 26, 336.3, 292/169.13, 169.14, 34, 42, 162, 359; 70/283, 210, 153, 167, 489

[56] References Cited

U.S. PATENT DOCUMENTS 2,506,851 5/1950 Ayers, Jr. ..... 70/283
3,234,763 2/1966 Russell et al. ..... 70/153
4,941,697 7/1990 Fan ..... 292/336.3
5,201,556 4/1993 Kendall ..... 292/257

*Primary Examiner*—Steven N. Meyers
*Assistant Examiner*—Tuyet-Phuong Pham
*Attorney, Agent, or Firm*—Robert F. Palermo; A. James Richardson; Salim A. Hasan

[57] ABSTRACT

A door lever assembly for disengaging an unlocked latch of a lockable door latch assembly includes a lever handle rotatably connected to a trim housing and a cam operably connected to the lever handle. The cam is positioned to rotate in response to rotation of the lever handle, converting its rotational movement to linear movement of a movable slider positioned adjacent to the cam. An electrically activated block arm is positionable to prevent movement of the movable slider, effectively locking the door lever assembly.

12 Claims, 6 Drawing Sheets

FAILSAFE ELECTRIC LOCKING LEVER TRIM

BACKGROUND OF THE INVENTION

The present invention relates to a door lever assembly that provides a failsafe mechanism for locking a door latch assembly. More specifically, the present invention relates to a door lever rotatably connected to a cam propelled slider for operating a door latch, with an electrically operated blocking arm selectively controlling movement of the slider.

Conventional door levers typically consist of a trim housing designed to accommodate a key cylinder lock positioned above a rotatable lever handle. The lever handle is ultimately connected to a door latch mechanism through a series of fixed or movable linkages that drive engagement or disengagement of one or more door latches. For example, the lever handle can be pinned to a shaft that extends through the trim housing to engage an eccentrically shaped cam. Turning the lever causes rotation of both the shaft and the cam, with the rotating cam upwardly impelling a slider having a connected lift arm. This upward movement of the lift arm in turn causes movement of vertical rods that retract the door latches.

In such a conventional door lever assembly, the door latch is locked by interrupting the linkage between the lift arm and the vertical rods. Rotation of the key cylinder swings a blocking slide (often called a "trim lock tumbler") into a position that prevents movement of the lift arm. This effectively prevents any movement of the attached slider, cam, shaft, and lever, as well as the vertical rods and connected door latches.

However, as will be appreciated by those skilled in the art, such key operated lock systems are not well suited to remote lock/unlock control. Further, in an emergency situation, use of a keyed lock device could slow or prevent emergency exit. What is needed is a door lever assembly that can be remotely locked or unlocked. Such a device should in addition have a failsafe feature that ensures the door lever assembly is unlocked if the remote locking mechanism is damaged. Finally, such a door lever assembly should further use conventional door lever assembly components as much as possible to reduce costs and simplify repair or replacement of components.

The foregoing illustrates limitations known to exist in present devices and methods. Thus, it is apparent that it would be advantageous to provide an alternative directed to overcoming one or more of the limitations set for above. Accordingly, a suitable alternative is provided including features more fully disclosed hereinafter.

SUMMARY OF THE INVENTION

In one aspect of the present invention, this is accomplished by a novel electrically lockable door lever assembly for controlling a door latch assembly. The door lever assembly includes a trim housing configured to present a plate and a lever handle rotatably connected to the trim housing. A cam is operably connected to the lever handle and positioned to rotate as the lever handle is rotated.

In response to rotation of the cam, a slider movably attached to the trim housing slides vertically upward. Movement of the slider controls operation of the door latch assembly, opening or closing the door latches to alternatively allow or prevent door opening. Locking the door by preventing engagement of the door latches by the lever/cam/slider combination is accomplished with a block arm assembly attached to the trim housing. The block arm assembly includes a block head selectively positionable in a locked position between the slider and the plate to prevent movement of the slider and its connected door latch assembly, the block head being moved to a locked position by electrical activation of a solenoid assembly. The block head is mechanically biased to return to an unlocked position by deactivation of the solenoid assembly.

The foregoing and other aspects will become apparent from the following detailed description of the invention when considered in conjunction with the accompanying drawing figures.

DETAILED DESCRIPTION

Figure 1:
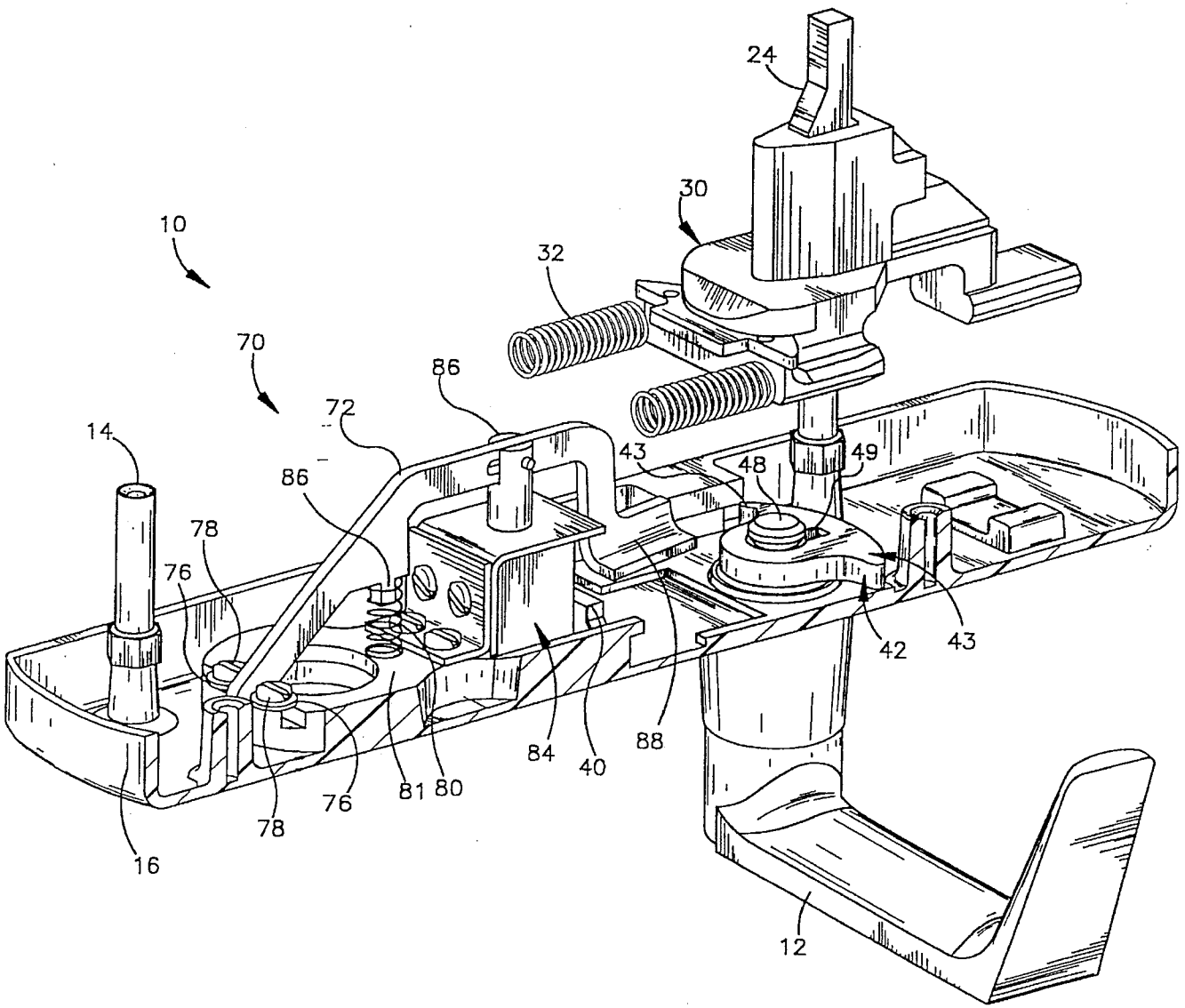
FIG. 1 is an exploded perspective view of a door lever assembly in accordance with the present invention, showing a block arm assembly in its unlocked, retracted position to allow movement of a slider.
Figure 2:
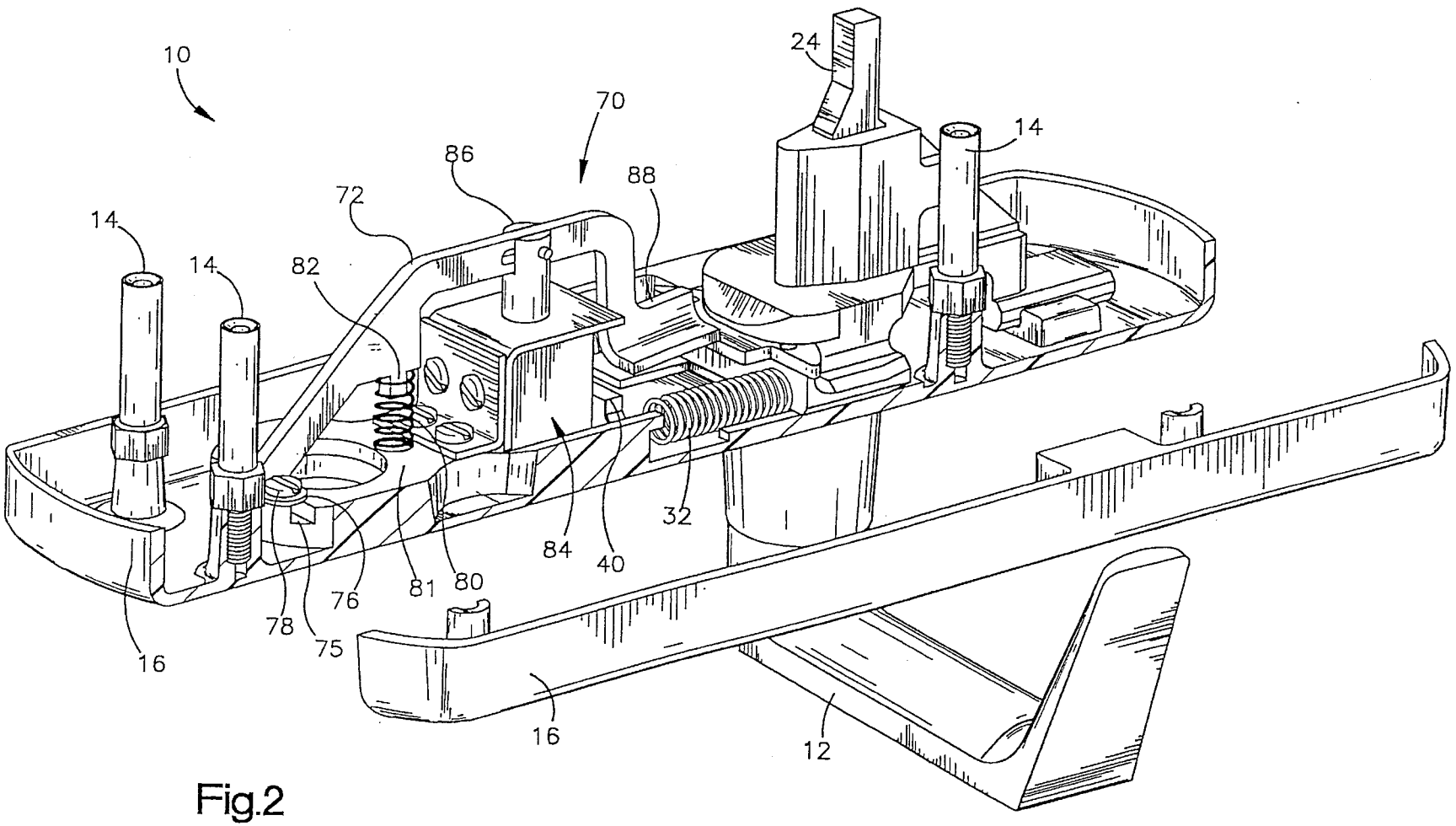
FIG. 2 is a perspective view similar to that shown in FIG. 1, with the slider properly positioned to move in response to cam rotation.
Figure 6:
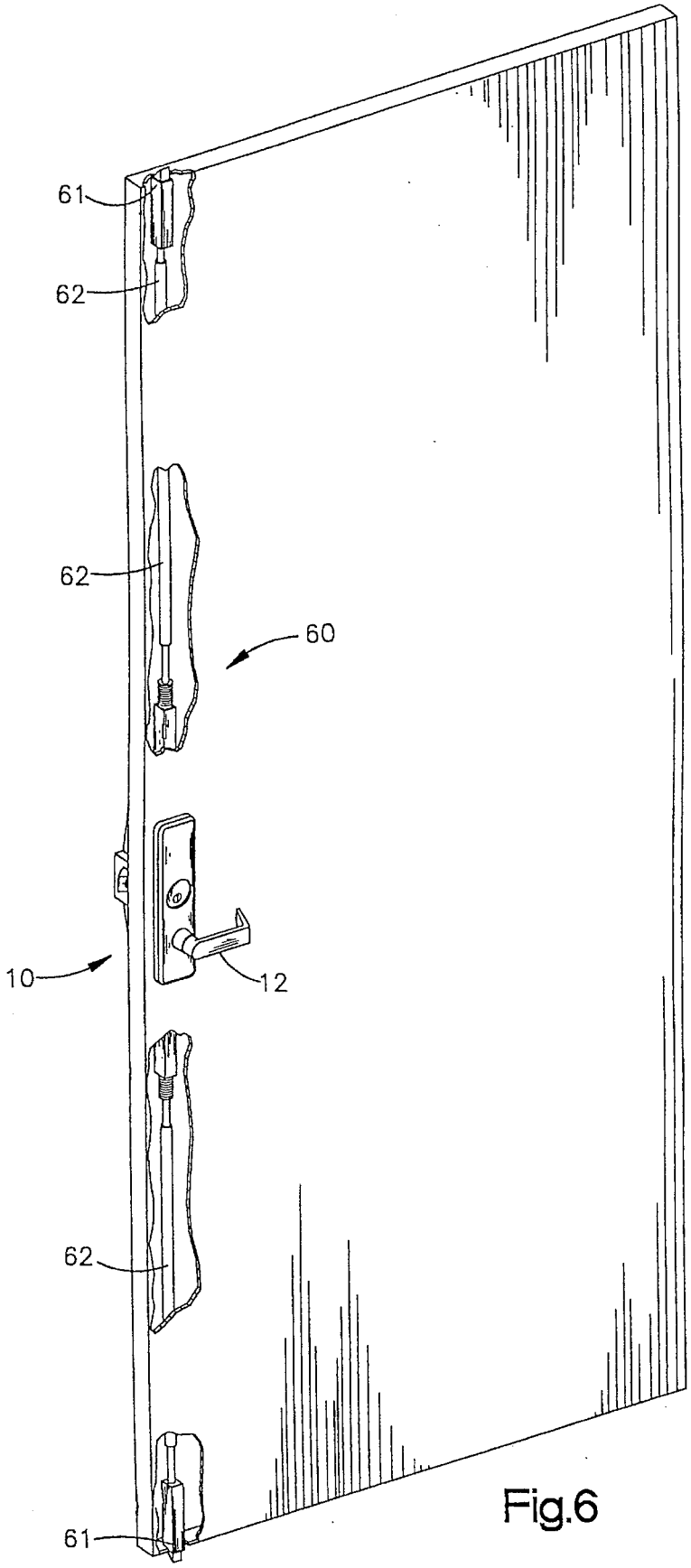
FIG. 6 is a perspective view of a door equipped with a door lever assembly of the present invention to control retraction of door latches, the door being partially broken away to indicate vertically extending rods in the door connected between the door latches and the lift arm of the door lever assembly, with the rods being movable in response to rotation of the unlocked door lever assembly.

As illustrated in FIGS. 1, 2, and 6, a door lever assembly 10 includes a lever handle 12 rotatably connected to a trim housing 16. Mounting studs 14 extending from the trim housing 16 are used to attach the trim housing 16 to a door 11.

The lever handle 12 and trim housing 16 are of conventional design and operation. In its unlocked position, turning the lever handle 12 of the door lever assembly 10 results retraction or extension of door latches 61 of a door latch assembly 60. The door latch assembly 60 includes vertical rods 62 that are indirectly connected to the lever handle 12 so that rotation of the lever handle 12 causes vertical movement of the rods 62, this vertical movement in turn causing retraction of the door latches 61.

A series of interlinked components provide the connection between the conventional lever handle 12 and the vertical rods 62. The lever handle is permanently attached to a shaft 48 that extends through the trim housing 16 to engage a cam 42. The cam 42 is attached to the shaft 48 by a shear pin 49 that projects outward from the shaft in one direction to fit into a channel defined in the cam 42. When the cam 42 is prevented from moving, excessive torque forces greater than a predetermined maximum applied to the shear pin 49 will result in breakage of the shear pin 49. The extension of the shear pin 49 in a single direction, as compared to extension from both sides of the shaft, results in improved breakage characteristics and more consistent breakage of the shear pin when the predetermined maximum torque force is applied. Breakage of the shear pin 49 allows the shaft 48 and connected lever handle 12 to spin freely, preventing any further damage to internal components of the door lever assembly 10.

In ordinary operation under typical turning torque forces, however, the connection of the shear pin 49 to the cam 42 simply permits manual rotation of the cam 42 driven by rotation of the door lever handle 12. The cam 42 is configured to present a pair of cam wings 43 that extend outward from the cam to engage a slider 30. Depending on the direction of rotation, one of the cam wings 43 slidably engages the slider 30, linearly pushing it upward and away from cam 42 against the force of compressible lift springs 32 toward a plate 40 integrally formed to project from the trim housing 16. Since the slider 30 supports an attached lift arm 24, linear movement of the slider also causes the lift arm 24 to upwardly move. The lift arm 24 is in turn attached to vertical rods 62 (rods 62 are indicated in FIG. 6) that control unlatching of latches 61 of the door latch assembly 60.

When the latches 61 are released, the door 11 opened, and the lever handle 12 released, the lift springs 32, which are attached between the plate 40 and the slider 30, force the slider 30 downward and away from the plate 40. As the slider 30 moves downward, it forces the cam 42 to rotate, which in turn forces rotation of the shaft 48 and connected lever handle 12. The lever handle 12 is therefore forced back into its initial substantially horizontal position upon its release.

Figure 3:
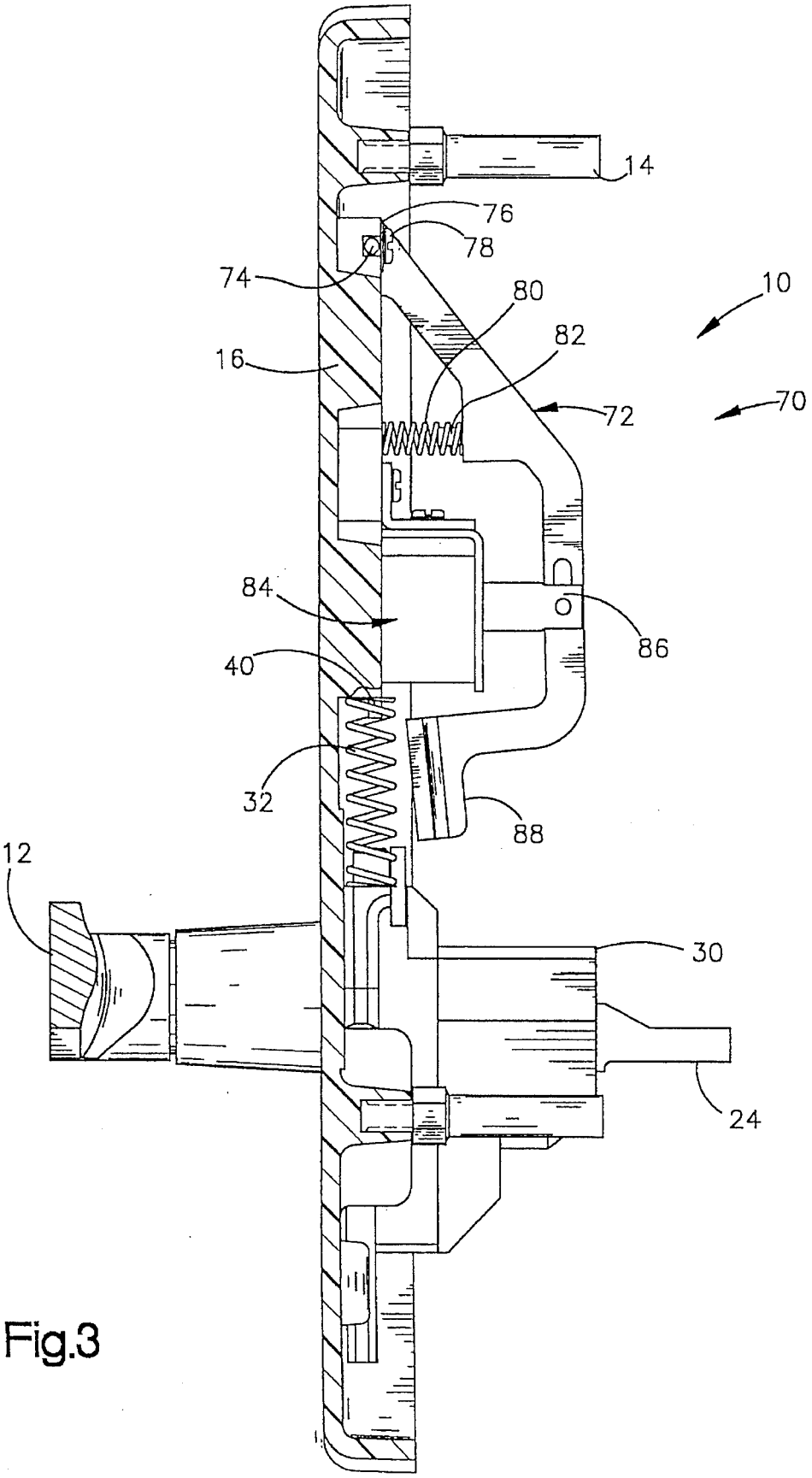
FIG. 3 is a side, cross sectional view of the door lever assembly illustrated in FIG. 2, showing a block arm of the block arm assembly pivoted about a dowel pin by extension of a solenoid plunger of a solenoid assembly to raise a block head out of the travel path of the slider.

In its locked position, the door lever assembly 10 provides for interruption of the foregoing linkages between the door lever handle 12 and the door latch assembly 60. As seen in an unlocked position in FIGS. 1, 2 and 3, and in a locked position in FIGS. 4 and 5, the door lever assembly 10 includes a block arm assembly 70 connected to the trim housing 16. The block arm assembly 70 has a generally U-shaped block arm 72 pivotally connected at one end to the trim housing 16 by a dowel pin 74. As best seen in FIG. 3, the dowel pin 74 is itself held to the trim housing 16 by a combination of washers 76 and machine screws 78.

At the end of the block arm 72 opposite the dowel pin 74, the block arm 72 supports an integrally attached block head 88. The block head 88 is dimensioned to fit in a gap between the plate 40 and the slider 30, when the slider 30 is in its initial position. Placement of the block head 88 in between the plate 40 and slider 30 locks the door lever assembly 10 by preventing movement of the slider 30, which in turn prevents movement of the connected lift arm 24 as well as the linked cam 42, shaft 48, and door lever handle 12.

As seen in FIGS. 1, 2, and 3, the block arm 72 is normally rotated so that the block head 88 is not positioned between the slider 30 and plate 40 to lock the door lever assembly 10. This is accomplished by use of a compression spring 80, attached between an aperture 81 defined in the trim housing and a tab 82 defined to project from the block arm 72. However, the biasing force of spring 80 can be overcome by activation of a solenoid assembly 84 to lock the door lever assembly 10.

Figure 4:
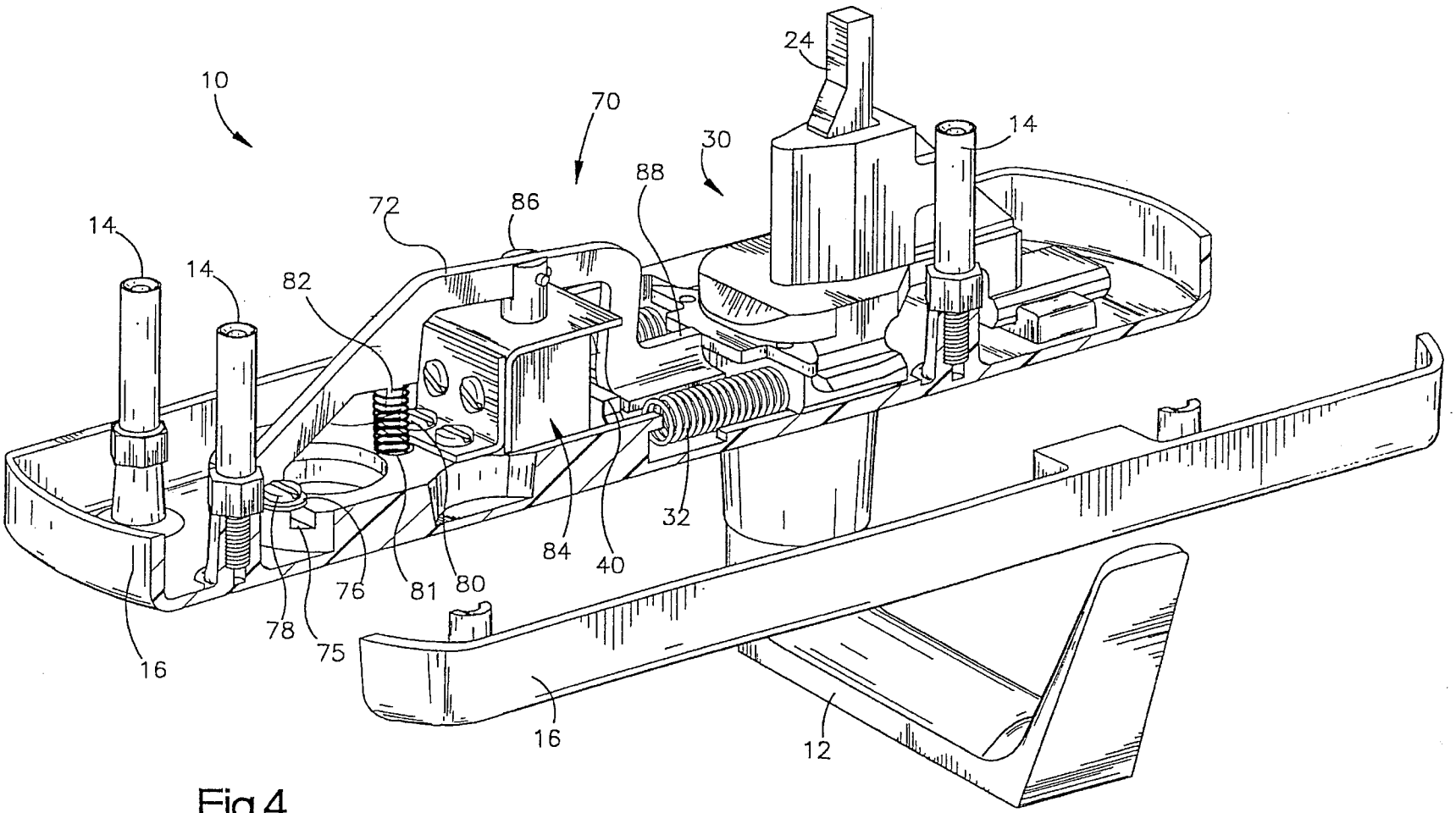
FIG. 4 is a perspective view of a door lever assembly with the electrically operated solenoid assembly activated to draw the solenoid plunger and connected block arm inward toward the trim housing, positioning the block head in the travel path of the slider and preventing engagement of a door latch assembly (not shown) by the lift arm.
Figure 5:
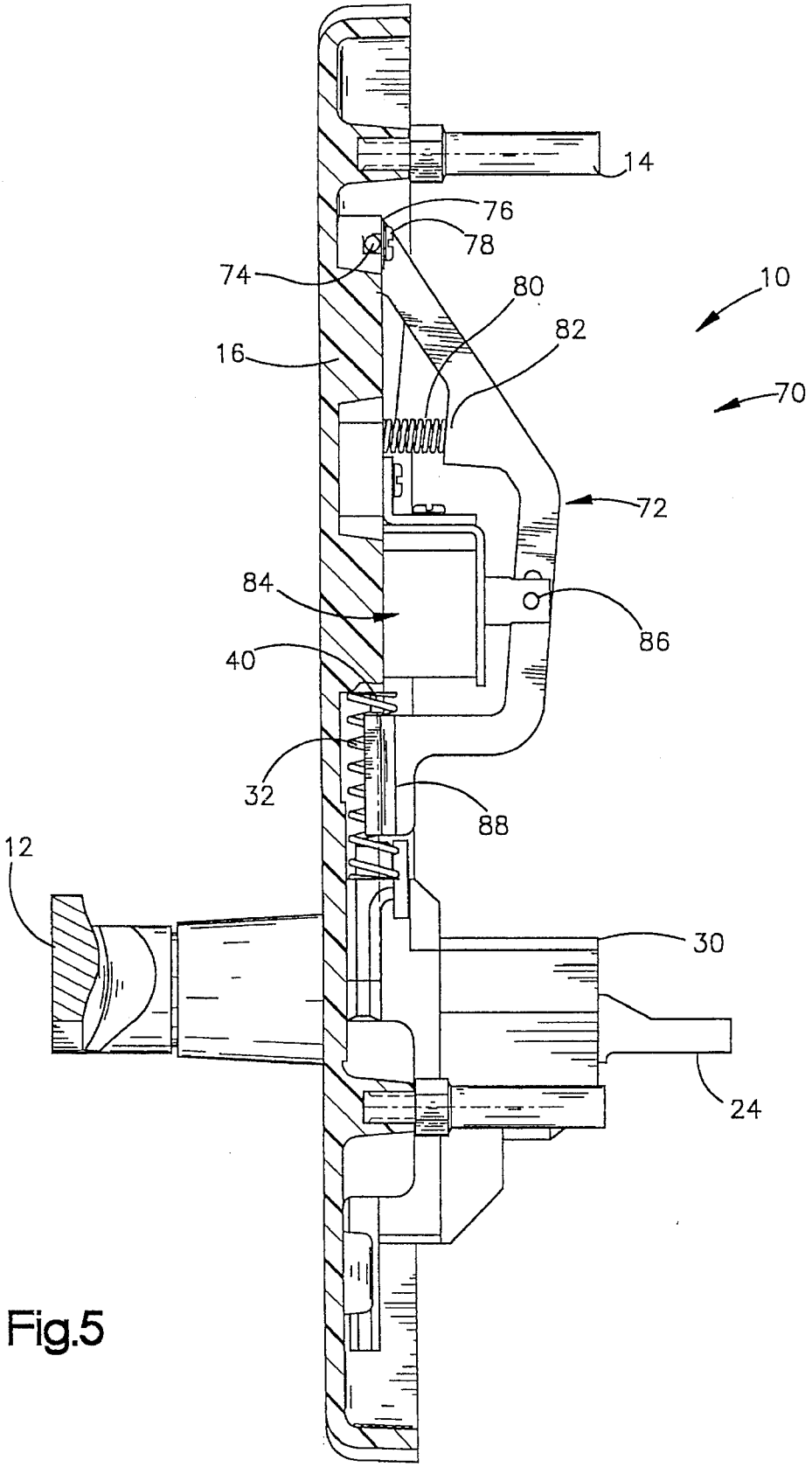
FIG. 5 is a side, cross sectional view of the door lever assembly shown in FIG. 4, with the relative position of the slider and the block head being illustrated.

The solenoid assembly 84 is of conventional construction and includes a movable solenoid plunger 86 connected to the block arm 72. When a remotely controlled electrical voltage (typically 24 volts DC) is applied across the solenoid assembly 84, a strong magnetic field is created to draw the solenoid plunger 86 inward toward the trim housing 16. Movement of the solenoid plunger 86 overcomes the resistance of the spring 80, and pulls the block head 88 into its locking position between the plate 40 and slider 30 (as best seen in FIGS. 4 and 5). As long as the electrical connection is maintained, the block head will remain in its lock position. However, if the electrical connection is broken, either deliberately or accidentally, the force of the spring 80 is directed to push the block arm and attached block head out of the lock position.

While the present invention has been described in connection with specific embodiments, it will be apparent to those skilled in the art that various changes may be made therein without departing from the spirit or scope of the invention.

What is claimed is:

1. An electrically lockable door lever assembly for controlling a door latch assembly, the door lever assembly comprising:

a trim housing configured to present a plate;

a lever handle rotatably connected to the trim housing;

a cam operably connected to the lever handle and positioned to rotate in response to rotation of the lever handle;

a slider movable in response to rotation of the cam, with movement of the slider controlling operation of the door latch assembly; and a block arm assembly attached to the trim housing, the block arm assembly comprising a block arm and an attached block head, with the block head selectively positionable by rotation of the block arm in a locked position between the slider and the plate to prevent movement of the slider and its connected door latch assembly, the block head being, moved to a locked position by electrical activation of a solenoid assembly connected between the trim housing and the block arm, and mechanically biased to return to an unlocked position by deactivation of the solenoid assembly.

2. The electrically lockable door lever assembly of claim 1, wherein the block arm assembly further comprises a dowel pin attached to the trim housing, with the block arm pivotally mounted to the dowel pin.

3. The electrically lockable door lever assembly of claim 1, wherein the block arm assembly further comprises a spring attached between the block arm and the trim housing, with the spring biased to urge the block arm for movement away from the trim housing.

4. The electrically lockable door lever assembly of claim 1, wherein the solenoid assembly further comprises a solenoid plunger attached to the block arm, with the solenoid plunger biased to urge the block arm for movement towards the trim housing when electrical activation of the solenoid assembly causes inward movement of the solenoid plunger, the block arm, and the block head toward the trim housing to a locked position that prevents movement of the slider in response to rotation of the lever handle.

5. The lever assembly of claim 1, further comprising a shaft attached between the lever handle and the cam, with a breakable shear pin attaching the shaft to the cam.

6. The lever assembly of claim 5, wherein the breakable shear pin extends outward from the shaft in only one direction to engage the cam.

7. The lever assembly of claim 1, further comprising a compressible lift spring positioned between the plate and the slider for compression as the slider moves toward the plate and expansion to move the slider away from the plate and return the lever handle to an initial position upon release of the lever handle.

8. An electrically lockable door lever assembly for controlling a door latch assembly, the door lever assembly comprising:

a trim housing configured to present a plate;

a lever handle rotatably connected to the trim housing;

a cam operably connected to the lever handle and positioned to rotate in response to rotation of the lever handle;

a slider movable in response to rotation of the cam, with movement of the slider controlling operation of the door latch assembly; and a block arm assembly attached to the trim housing and having a block head selectively positionable in a locked position between the slider and the plate to prevent movement of the slider and its connected door latch assembly, the block head being moved to a locked position by electrical activation of a solenoid assembly, and mechanically biased to return to an unlocked position by deactivation of the solenoid assembly.

9. The lever assembly of claim 8, wherein the cam has an eccentric configuration which, upon rotation, provides vertical motion to the slider, the cam being attached to a shaft extending from the lever handle with a breakable shear pin attaching the cam to the shaft so that excessive torque on the shaft will cause failure of the shear pin and disengage the cam and the shaft.

10. The lever assembly of claim 9, wherein the breakable shear pin extends outward from the shaft in only one direction to engage the cam.

11. The lever assembly of claim 10, further comprising a plate, said plate being attached to the trim housing, and a compressible lift spring positioned between the plate and the slider for compression as the slider is urged by rotation of the cam toward the plate when the lever handle is rotated and for expansion to move the slider away from the plate, and to urge rotation of the cam to bring the attached lever handle to a horizontal position when the lever handle is released.

12. An electrically lockable door lever assembly for controlling a door latch assembly, the door lever assembly having a trim housing that supports a plate, the door lever assembly comprising:

a lever handle rotatably connected to the trim housing;

a slider connected to move in response to rotation of the lever handle, with movement of the slider controlling operation of the door latch assembly; and a block arm assembly comprising a block arm and an attached block head, with the block head selectively positionable by rotation of the block arm in a locked position between the slider and the plate to prevent movement of the slider and its connected door latch assembly, the block head being moved to a locked position by electrical activation of a solenoid assembly connected between the trim housing and the block arm, and mechanically biased to return to an unlocked position by deactivation of the solenoid assembly.

* * * * *